US008746692B2

(12) United States Patent
Richards et al.

(10) Patent No.: US 8,746,692 B2
(45) Date of Patent: Jun. 10, 2014

(54) MOVEABLE DRIVE NIP

(75) Inventors: Paul N. Richards, Fairport, NY (US); Lloyd A. Williams, Mahopac, NY (US); Joannes N. M. deJong, Hopewell Junction, NY (US); Matthew Dondiego, West Milford, NJ (US)

(73) Assignee: Xerox Corporation, Norwalk, CT (US)

( * ) Notice: Subject to any disclaimer, the term of this patent is extended or adjusted under 35 U.S.C. 154(b) by 447 days.

(21) Appl. No.: 12/433,069

(22) Filed: Apr. 30, 2009

(65) Prior Publication Data

US 2010/0276877 A1 Nov. 4, 2010

(51) Int. Cl.
*B65H 7/10* (2006.01)

(52) U.S. Cl.
USPC ..... 271/228; 271/249; 271/252

(58) Field of Classification Search
USPC ..... 271/228, 249, 252, 207
See application file for complete search history.

(56) References Cited

U.S. PATENT DOCUMENTS

| | | | |
|---|---|---|---|
| 2,632,641 | A | 3/1953 | Rice |
| 3,025,055 | A | 3/1962 | Bryant |
| 3,854,315 | A | 12/1974 | Winkler |
| 4,228,994 | A | 10/1980 | Volpe |
| 4,558,373 | A | 12/1985 | Plasencia et al. |
| 4,630,815 | A | 12/1986 | Petersen et al. |
| 4,685,664 | A | 8/1987 | Petersdorf |
| 4,833,989 | A | 5/1989 | Wieland |
| 4,917,370 | A | 4/1990 | Batts |
| 4,971,304 | A | 11/1990 | Lofthus |
| 4,971,311 | A | 11/1990 | Tsukimoto |
| 5,004,222 | A | 4/1991 | Dobashi |
| 5,094,442 | A | 3/1992 | Kamprath et al. |
| 5,167,751 | A | 12/1992 | Shimizu et al. |
| 5,169,140 | A | 12/1992 | Wenthe, Jr. |
| 5,198,067 | A | 3/1993 | Sumi et al. |
| 5,209,465 | A | 5/1993 | Sayama et al. |
| 5,219,159 | A | 6/1993 | Malachowski et al. |
| 5,278,624 | A | 1/1994 | Kamprath et al. |
| 5,313,253 | A | 5/1994 | Martin et al. |

(Continued)

FOREIGN PATENT DOCUMENTS

| | | | |
|---|---|---|---|
| JP | 60002547 | A | 1/1985 |
| JP | 60082553 | A | 5/1985 |

(Continued)

OTHER PUBLICATIONS

Karns, Kara L., An Empirical Evaluation of Nip Mechanics as it Impacts Paper Drive Variability in a Registration System, Xerox Internal Report Data Sheet, Accession No. X9500117, Issued May 9, 1995.

*Primary Examiner* — Ernesto Suarez
(74) *Attorney, Agent, or Firm* — Fox Rothschild LLP

(57) ABSTRACT

Systems for moving a moveable drive module in a cross-process direction are disclosed. A system includes a moveable drive module including a drive roll and a translation drive motor capable of moving the moveable drive module in a cross-process direction. The system may optionally include a plurality of idler rolls, each configured to be associated with the drive roll when the moveable drive module is in an associated position. Optionally, the moveable drive module may further include an idler roll associated with the drive roll. Alternately, the system may further include a moveable idler module including an idler roll and a translation drive motor capable of moving the moveable idler module in a cross-process direction.

9 Claims, 9 Drawing Sheets

(56) References Cited

U.S. PATENT DOCUMENTS

| | | | | |
|---|---|---|---|---|
| 5,697,608 | A | 12/1997 | Castelli et al. | |
| 5,778,300 | A * | 7/1998 | Murakami et al. | 399/403 |
| 5,887,996 | A | 3/1999 | Castelli et al. | |
| 6,007,063 | A | 12/1999 | Park | |
| 6,019,365 | A * | 2/2000 | Matsumura | 271/227 |
| 6,059,285 | A * | 5/2000 | Suga et al. | 271/228 |
| 6,137,989 | A | 10/2000 | Quesnel | |
| 6,168,153 | B1 | 1/2001 | Richards et al. | |
| 6,173,952 | B1 | 1/2001 | Richards et al. | |
| 6,338,483 | B1 | 1/2002 | Andela et al. | |
| 6,374,075 | B1 | 4/2002 | Benedict et al. | |
| 6,533,268 | B2 | 3/2003 | Williams et al. | |
| 6,736,394 | B2 | 5/2004 | Herrmann et al. | |
| 6,817,611 | B2 | 11/2004 | DiRamio | |
| 6,860,204 | B2 | 3/2005 | Hashiguchi | |
| 7,121,546 | B2 | 10/2006 | Johnson et al. | |
| 7,195,238 | B2 | 3/2007 | Suga et al. | |
| 7,243,917 | B2 | 7/2007 | Knierim et al. | |
| 7,252,287 | B2 | 8/2007 | Tsutoh | |
| 7,258,340 | B2 * | 8/2007 | Clark et al. | 271/228 |
| 7,422,209 | B2 | 9/2008 | Hashimoto | |
| 7,527,263 | B2 | 5/2009 | DeGruchy et al. | |
| 7,677,558 | B2 * | 3/2010 | Kinoshita et al. | 271/227 |
| 7,686,299 | B2 | 3/2010 | Herrmann | |
| 7,819,399 | B2 | 10/2010 | Choi | |
| 2003/0146567 | A1 | 8/2003 | Williams et al. | |
| 2006/0071419 | A1 | 4/2006 | Lee | |
| 2006/0181015 | A1 | 8/2006 | Takahashi | |
| 2006/0261540 | A1 | 11/2006 | Loiselle et al. | |
| 2009/0121419 | A1 | 5/2009 | deJong et al. | |
| 2010/0090391 | A1 | 4/2010 | deJong et al. | |
| 2010/0276873 | A1 * | 11/2010 | Richards et al. | 271/234 |
| 2010/0327513 | A1 | 12/2010 | Richards et al. | |

FOREIGN PATENT DOCUMENTS

| | | | |
|---|---|---|---|
| JP | 61229748 | A | 10/1986 |
| JP | 63306145 | A | 12/1988 |
| JP | 1187151 | | 7/1989 |

* cited by examiner (KNOWN ART)

(KNOWN ART)

MOVEABLE DRIVE NIP

CROSS-REFERENCE TO RELATED APPLICATIONS

This application is related to U.S. patent application Ser. No. 12/433,008 filed Apr. 30, 2009.

BACKGROUND

The present disclosure generally relates to document processing devices and methods for operating such devices. More specifically, the present disclosure relates to methods and systems for adjusting the cross-process position of a drive nip in a document processing device to, for example, account for a range of media sizes.

Typical document processing devices typically include one or more sets of nips used to register and transport media (i.e., sheets) within the device. A nip provides a force to a sheet as it passes through the nip to propel it forward through the document processing device. Depending upon the size of the sheet that is being registered or transported, one or more nips in a set of nips might not contact the sheet as it is being registered or transported.

FIG. 1A depicts a top view of a portion of a document processing device known in the art. As shown in FIG. 1A, the document processing device 100 includes three sets of nips 105*a-b*, 110*a-b*, and 115*a-b*. The first set of nips 105*a-b* are used to transport a sheet; the second set of nips 110*a-b* are used to perform sheet registration; and the third set of nips 115*a-b* are used to transport a sheet in a process direction. Although two nips are shown for each set of nips, additional or fewer nips can be used. In some cases, additional nips are used to account for variations in sheet size during the transport or registration processes.

As shown in FIG. 1B, each nip in a set of nips, such as 115*a-b*, includes a drive roll, such as 125, and an idler roll, such as 130. A normal force is caused at each nip by loading the idler roll 130. Friction between the sheet and each nip 115*a-b* is used to produce a normal force that propels the sheet in a process direction. Typically, each idler roll 130 is mounted independently from the other idler rolls in a set of nips.

FIG. 2 depicts a conventional three nip embodiment for a sheet registration system. As shown in FIG. 2, the sheet registration system may include three drive modules 205, 210 and 215. Each drive module includes a drive motor, such as 205*a*, a drive belt, such as 205*b*, and a drive roll, such as 205*c*. The drive motor 205*a* is controlled by a controller (not shown) that determines the rotational velocity of a drive shaft 205*d* of the drive motor. Because the drive shaft 205*d* is operably connected to the drive roll 205*c* via the drive belt 205*b*, the drive roll can be rotated at a determined angular velocity based on the angular velocity of the drive shaft.

Each drive module 205, 210 and 215 is fixed in a known cross-process location. As such, the drive roll of an inbound drive module, such as 205*c*, may only contact a sheet if the sheet is of sufficient size to contact the drive rolls of all three drive modules 205, 210 and 215. As a result, drive motor 205*a*, drive belt 205*b* and drive roll 205*c* may be underutilized as compared with the drive motors, drive belts and drive rolls of drive modules 210 and 215.

Typical registration systems in a document processing device have fixed location drive modules for orienting a sheet prior to image transfer. The location or placement of each fixed drive module in a cross-process direction is selected in order to enable performance across a wide range of media (i.e., sheet) sizes. However, sheets that are comparatively large in size and/or weight require a wide stance for optimal control. As such, selecting fixed positions that do not account for such sizes can jeopardize hardware registration performance.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "nip" is a reference to one or more nips and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a system may include a moveable drive module comprising a drive roll and a translation drive motor capable of moving the moveable drive module in a cross-process direction, and a plurality of idler rolls. A first idler roll may be configured to be associated with the drive roll when the moveable drive module is in a first position. A second idler roll may be configured to be associated with the drive roll when the moveable drive module is in a second position.

In an embodiment, a system may include a moveable drive module comprising a drive roll, an idler roll associated with the drive roll, and a translation drive motor capable of moving the moveable drive module in a cross-process direction.

In an embodiment, a system may include a moveable drive module comprising a drive roll and a first translation drive motor capable of moving the moveable drive module in a cross-process direction, and a moveable idler module comprising an idler roll and a second translation drive motor capable of moving the moveable idler module in a cross-process direction.

BRIEF DESCRIPTION OF THE DRAWINGS

Aspects, features, benefits and advantages of the present invention will be apparent with regard to the following description and accompanying drawings, of which.

DETAILED DESCRIPTION

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which a document is moved and processed.

A "nip" refers to a location in a document processing device at which a force is applied to a document, such as a sheet, to propel the sheet in a process direction. A nip may include, for example and without limitation, a drive roll and an idler roll.

A "drive roll" refers to a nip component that is designed to propel a document, such as a sheet, in contact with the nip. A drive roll may comprise a compliant material, such as rubber, neoprene or the like. A drive roll may be directly driven via a stepper motor, a DC motor or the like. Alternately, a drive roll may be driven using a gear train, belt transmission or the like.

An "idler roll" refers to a nip component that is designed to provide a normal force against a document, such as a sheet, in order to enable the sheet to be propelled by the drive roll. An idler roll may comprise a non-compliant material, such as plastic.

A "positioning shaft" refers to a shaft on which a moveable drive module (or other moveable module) is mounted which allows the module to be moved in a cross-process direction. A positioning shaft may be a threaded shaft.

A "drive motor" refers to a motor utilized to drive a drive belt. In an embodiment, the drive motor may drive a drive belt operably connected to a drive roll. A drive motor may be included as part of a drive module, although alternate drive motor placements are envisioned within the scope of this disclosure.

A "translation drive motor" refers to a drive motor utilized to move a moveable drive module (or other moveable module) in a cross-process direction. A translation drive motor may be part of or separate from a moveable module. In embodiments described herein, the translation drive motor may drive both a first drive belt operably connected to a drive roll and a second drive belt designed to move a moveable module in a cross-process direction.

A "cross-process direction" is a direction that is substantially perpendicular to the process flow followed by an object to be moved by the system, such as a document in a document processing device. For example, a cross-process direction may be substantially parallel to the length of an axle on which a drive wheel of a document processing device is located.

Figure 1A:
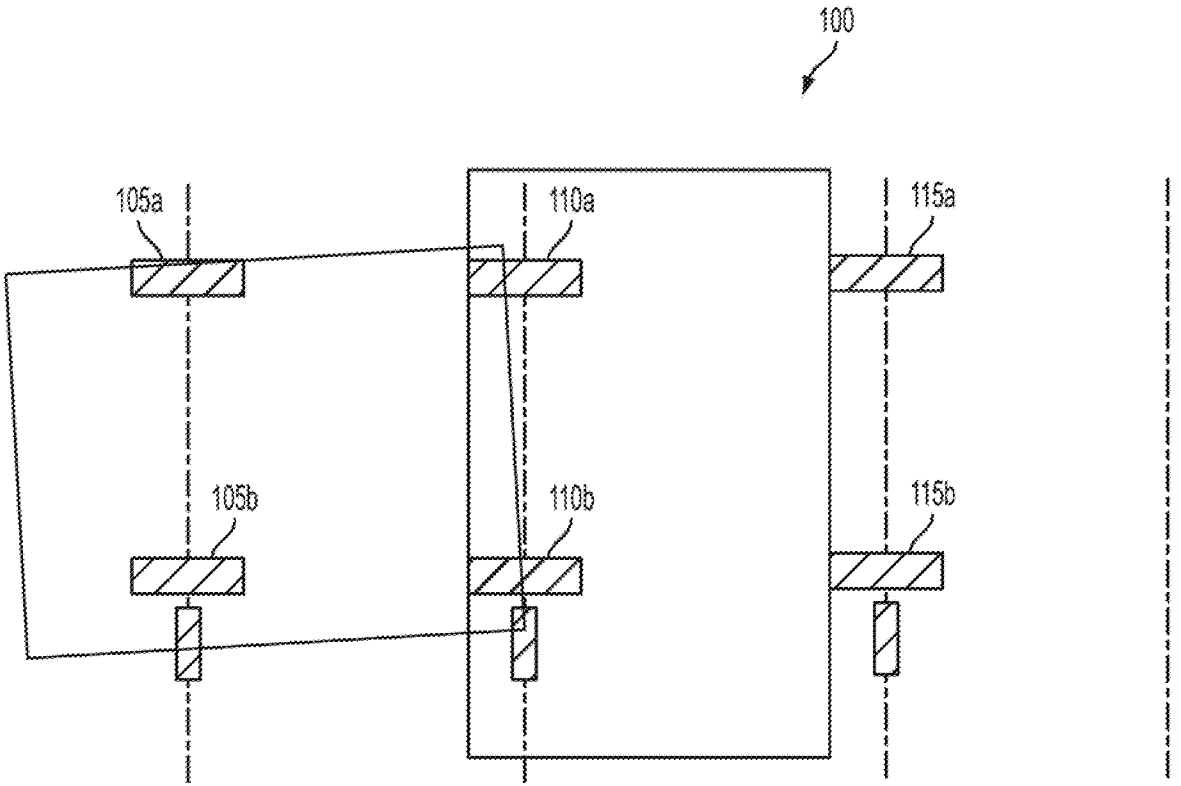
FIG. 1A depicts a top view of a portion of a conventional document processing device.
Figure 1B:
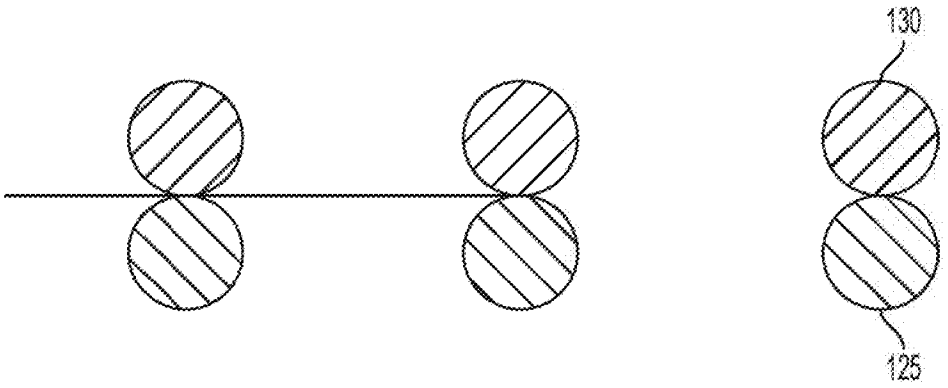
FIG. 1B depicts a lateral view of a sheet transport system for a conventional document processing device.
Figure 2:
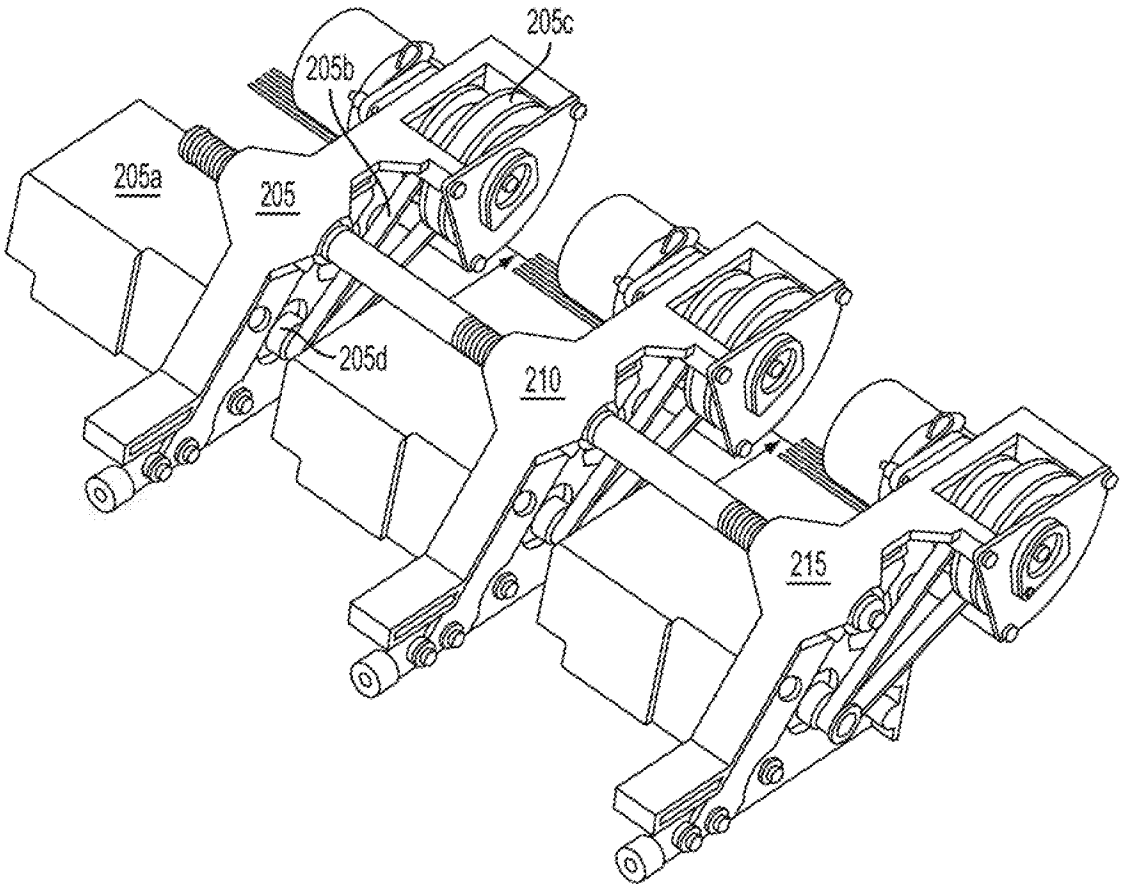
FIG. 2 depicts a conventional three nip embodiment for a sheet registration system.

The system described herein advantageously reduces the cost of a sheet registration and/or transport system that registers sheets of varying sizes by reducing the number of components required for such a system. Rather than including three drive modules as shown in FIG. 2 above, the presently disclosed system merely uses two drive modules. Furthermore, a weight reduction may occur as a result of the reduction in the number of components. In addition, fewer consumable components, such as drive rolls, may be utilized by such systems, which would further reduce operating costs. Such registration/transport systems may be used, for example and without limitation, in a document processing device.

Figure 3A:
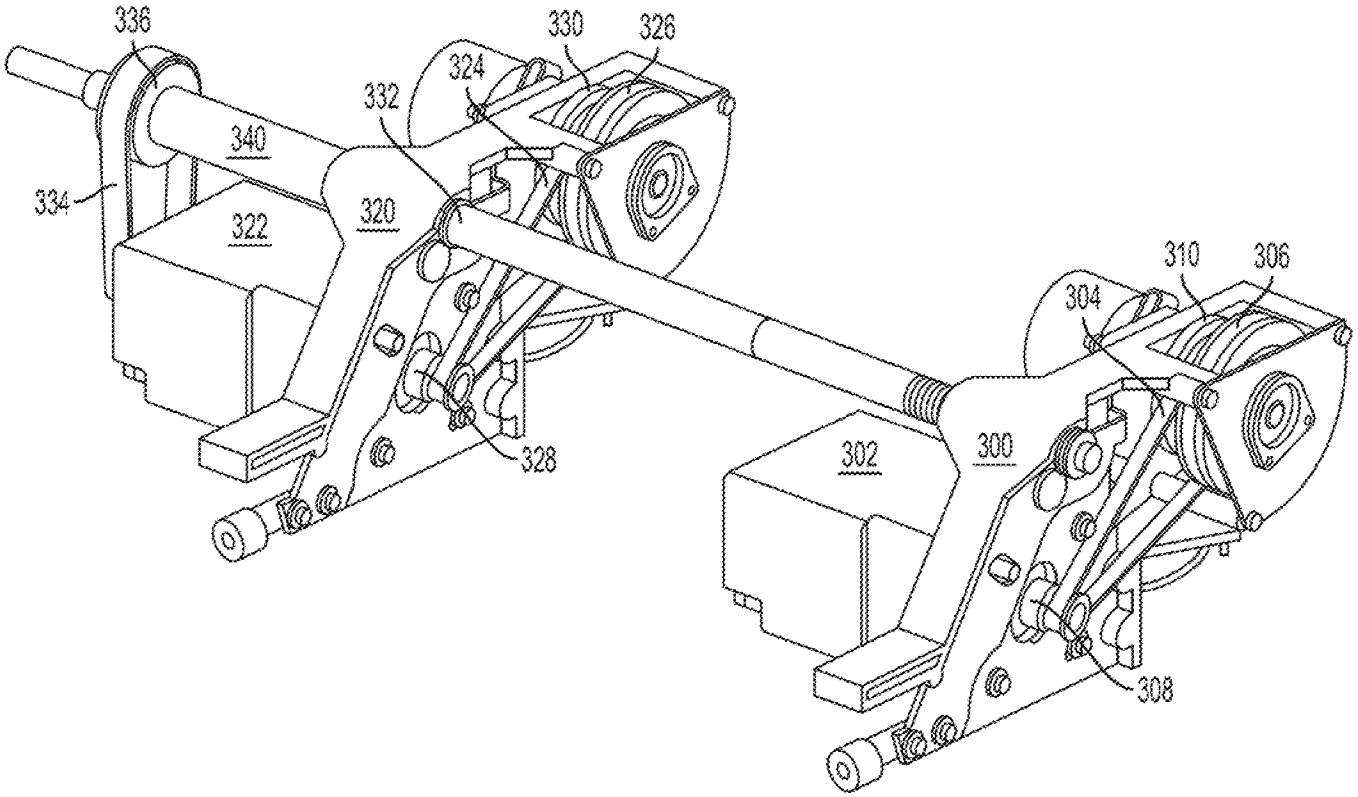
FIGS. 3A and 3B depict views of an exemplary sheet registration/transportation system having a moveable drive module in an inboard position and an outboard position, respectively, according to an embodiment.
Figure 3B:
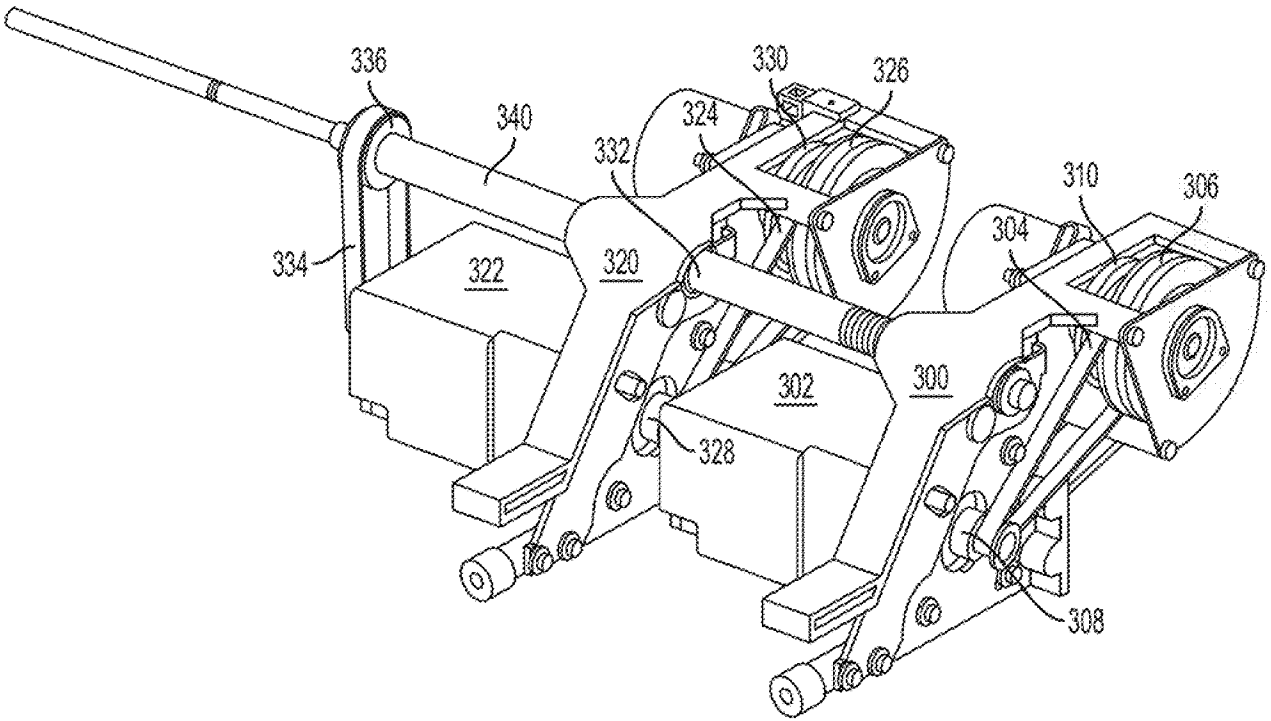

FIGS. 3A and 3B depict views of an exemplary registration/transportation system having a moveable drive module in an inboard position and an outboard position, respectively, according to an embodiment. As shown in FIGS. 3A and 3B, a sheet registration system may include an outboard drive module 300, an inboard drive module 320, and a cross-process positioning system, such as positioning shaft 340. In an embodiment, the outboard drive module 300 may be fixed in a cross-process direction, and the inboard drive module 320 may be moveable in a cross-process direction.

The outboard drive module 300 may include a drive motor 302, a drive belt 304, and a drive roll 306. The drive belt 304 may be used to operably connect a drive shaft 308 of the drive motor 302 to a pulley 310 in connection with the drive roll 306. In operation, the drive motor 302 may cause the drive shaft 308 to rotate with an angular velocity. The angular velocity of the drive shaft 308 may be based on, for example, the voltage supplied to the drive motor 302. As such, the angular velocity of the drive shaft 308 may be controllable.

The rotation of the drive shaft 308 causes the drive belt 304 to rotate the pulley 310. The angular velocity of the pulley 310 is proportional to the angular velocity of the drive shaft 308 based on the radius of the drive shaft and the pulley. The rotation of the pulley 310 causes the drive roll 306 to rotate via a common axle (not shown).

The elements of the inboard drive module 320 may be substantially similar to those of the outboard drive module 300 (i.e., a drive motor 322, a drive belt 324, a drive roll 326, a drive shaft 328 and a drive pulley 330), except that the drive motor of the inboard drive module may be a translation drive motor. Moreover, the operation of the above-listed elements with respect to imparting an angular velocity to the drive roll 326 may be substantially similar to the operation of the elements of the outboard drive module 300.

The inboard drive module 320 may additionally include a hub 332 that operably connects the inboard drive module to the positioning shaft 340. In an embodiment, the hub 332 may encircle the positioning shaft 340 and may include an internal thread. The positioning shaft 340 may be threaded on its exterior such that the thread of the positioning shaft is engaged with the internal thread of the hub 332.

The inboard drive module 320 may further include a second belt 334 and a second pulley 336. The second belt 334 may operably connect the drive shaft 328 of the translation drive motor 322 to the second pulley 336, which is, in turn, operably connected to the positioning shaft 340. In operation, the translation drive motor 322 may cause the drive shaft 328 to rotate. The rotation of the drive shaft 328 may cause the second belt 334 to rotate the second pulley 336. The rotation of the second pulley 336 causes the positioning shaft 340 to turn on its axis. As a result, the positioning shaft 340 causes movement of the inboard drive module 320 in a cross-process direction by the engagement between the external thread of the positioning shaft and the internal thread of the hub 332.

In an embodiment, the translation drive motor 322 may include a clutch that prevents movement of the drive belt 324 by the translation drive motor when the inboard drive module 320 is to be moved and prevents movement of the second belt 334 by the translation drive motor when the drive roll 326 is to be rotated. In such an embodiment, only one of the drive roll 326 and the inboard drive module 320 may be moved at any given time.

In an embodiment, the translation drive motor 322 may cause the drive shaft 328 and the positioning shaft 340 to rotate in either a clockwise or counterclockwise direction depending upon the direction in which the inboard drive module 320 is desired to be moved. For example, the translation drive motor 322 may be driven in a forward direction to rotate the positioning shaft 340 in a first direction and in a reverse direction to rotate the positioning shaft in a direction opposite the first direction. Additional and/or alternate methods of enabling rotation of the positioning shaft 340 in both a clockwise and counterclockwise direction are included within the scope of this disclosure.

Figure 4A:
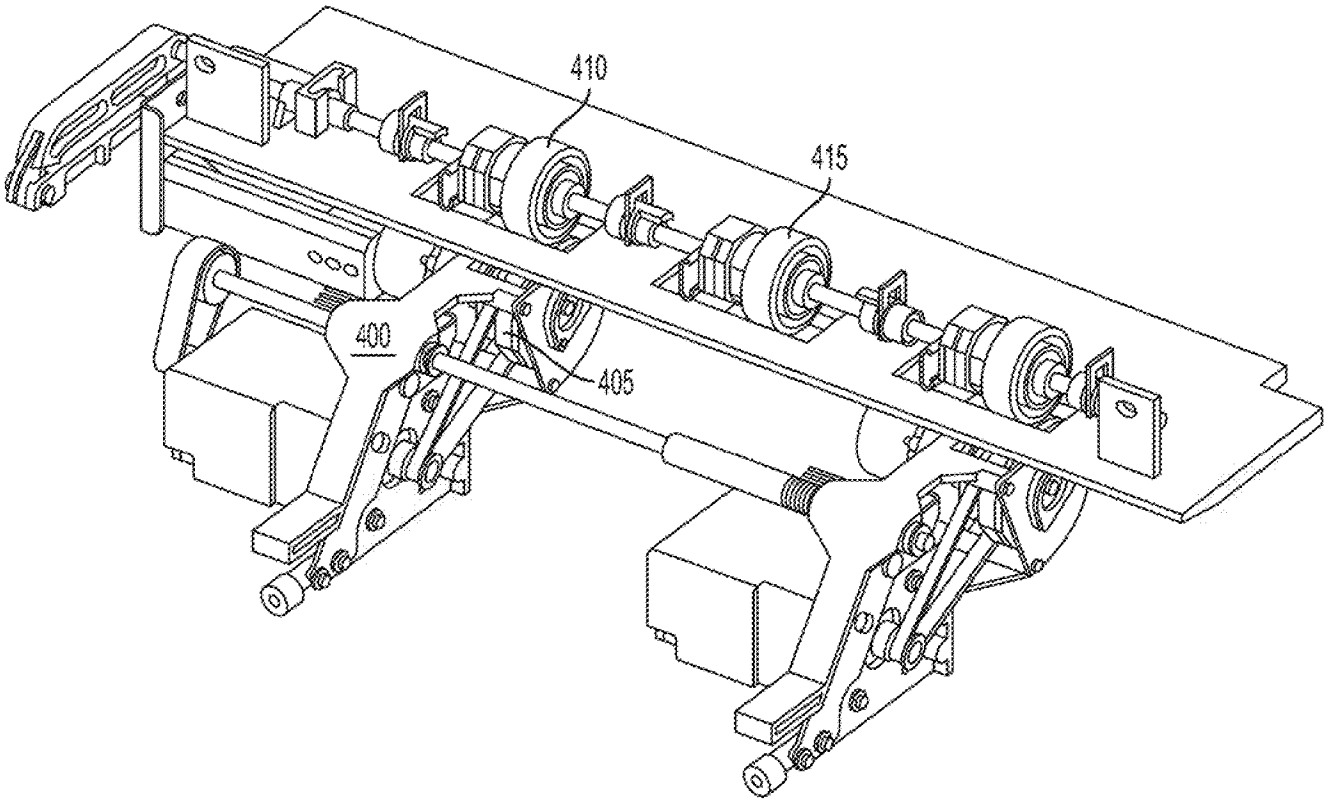
FIGS. 4A and 4B depict views of a moveable drive module in an inboard position and an outbound position, respectively, and a plurality of idler rolls according to an embodiment.
Figure 4B:
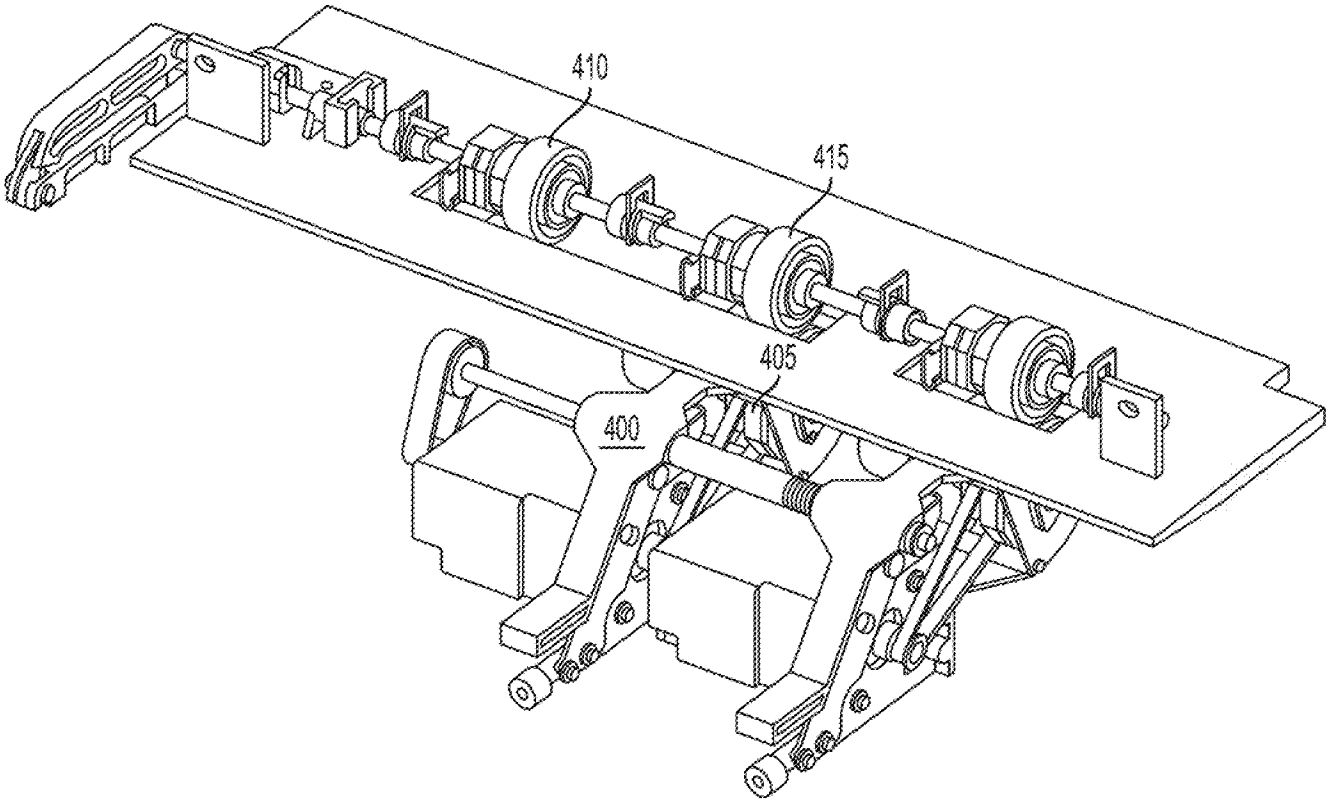

FIGS. 4A and 4B depict views of a moveable drive module in an inboard position and an outbound position, respectively, and a plurality of idler rolls according to an embodiment. As shown in FIGS. 4A and 4B, a moveable drive module 400 may move along a shaft substantially as described above. For example, the moveable drive module 400 may include the moveable drive module shown in FIGS. 3A and 3B or any other moveable drive module.

The moveable drive module 400 may include a drive roll 405. In order to form a nip, the drive roll 405 may be required to be associated with an idler roll. As such, a first idler roll 410 may be located such that the drive roll 405 is associated with the first idler roll when the moveable drive module 400 is in an inboard position, as shown in FIG. 4A. When the moveable drive module 400 is moved to an outboard position, such as is shown in FIG. 4B, the drive roll 405 may instead be associated with a second idler roll 415 to form a nip in an outboard position. Each of the first idler roll 410 and the second idler roll 415 may be substantially fixed in a cross-process direction. In an alternate embodiment, one or more of the first drive roll 410 and the second drive roll 415 may be configured to be movable in a cross-process direction to accommodate additional positions for the drive roll 405. Although FIGS. 4A and 4B depict two idler rolls 410, 415, additional idler rolls may be used within the scope of this disclosure to accommodate additional positions for the drive roll 405.

Figure 5A:
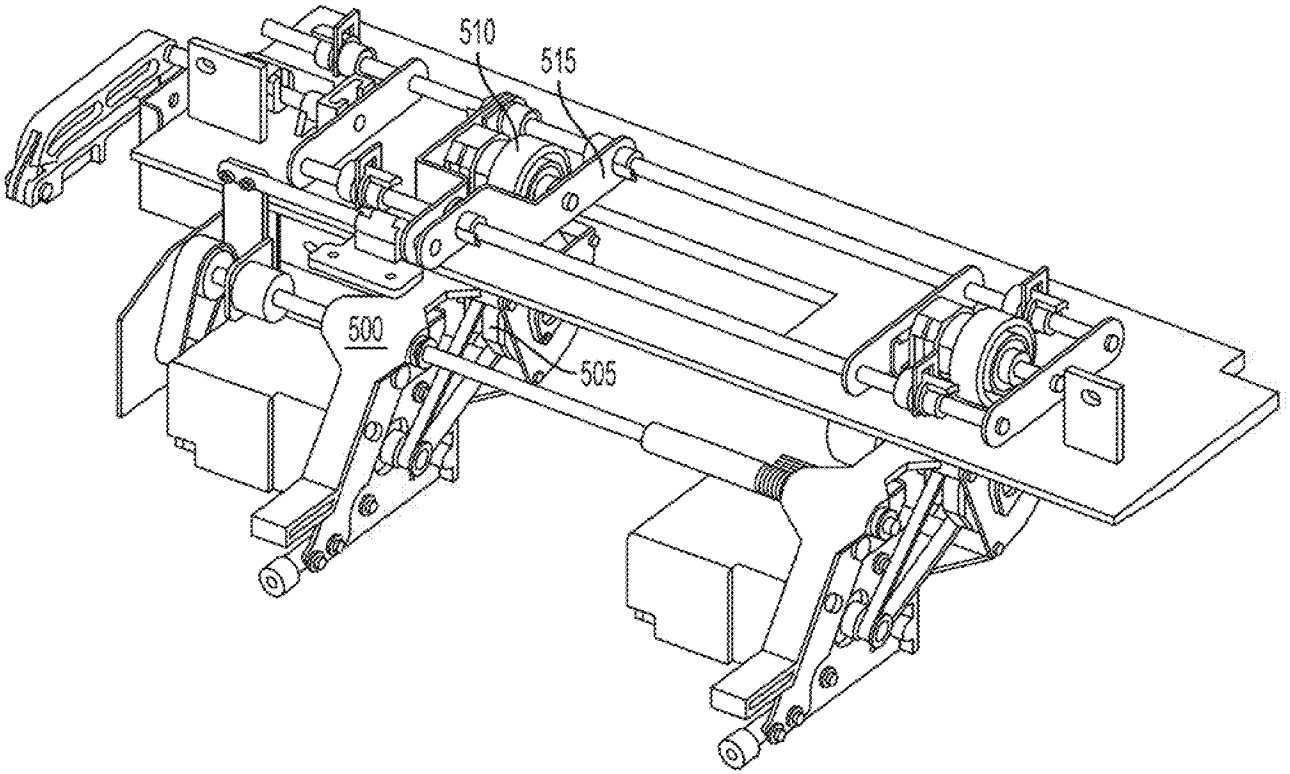
FIGS. 5A and 5B depict views of a moveable drive module and a corresponding moveable idler module in an inboard position and an outboard position, respectively, according to an embodiment.
Figure 5B:
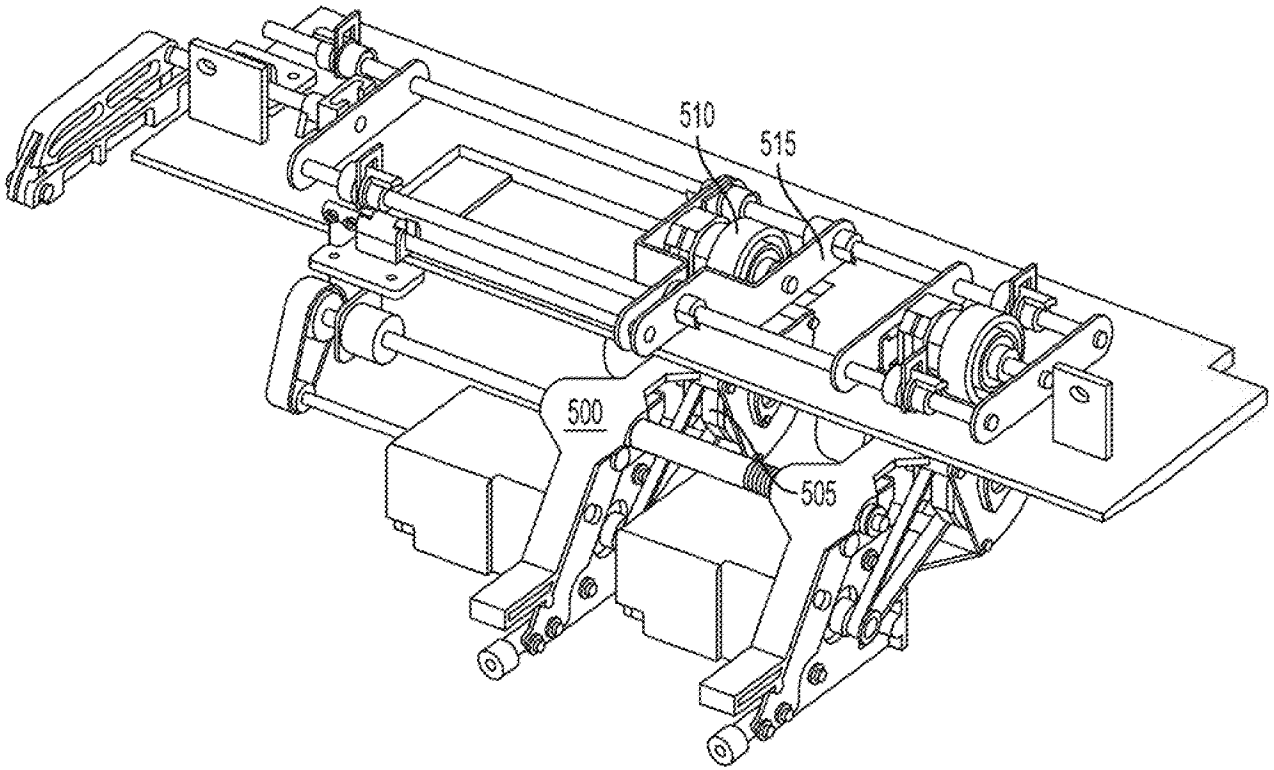

FIGS. 5A and 5B depict views of a moveable drive module and a corresponding moveable idler module in an inboard position and an outboard position, respectively, according to an embodiment. As shown in FIGS. 5A and 5B, a moveable drive module 500 may move along a shaft substantially as described above. For example, the moveable drive module 500 may include the moveable drive module shown in FIGS. 3A and 3B or any other moveable drive module.

The moveable drive module 500 may include a drive roll 505. The drive roll 505 may be associated with an idler roll 510. In an embodiment shown in FIGS. 5A and 5B, the idler roll 510 may be part of a moveable idler module 515 that is separate from the moveable drive module 500. The moveable idler module 515 may cause the idler roll 510 to be moved in a cross-process direction to a position that is associated with the drive roll 505. In an embodiment, the moveable idler module 515 may be moved at substantially the same time and substantially the same velocity as the moveable drive module 500. In an alternate embodiment, the moveable idler module 515 may be moved at a different time and/or at a different velocity than the moveable drive module 500. In an embodiment, a second translation drive motor (i.e., a different translation drive motor than the one that moves the moveable drive module 500) may cause the moveable idler module 515 to move in a cross-process direction. Alternately, the translation drive motor 500 used to move the moveable drive module may cause the moveable idler module 515 to move in a cross-process direction.

The moveable idler module 515 may be substantially similar to the moveable drive module 320 described in reference to FIGS. 3A and 3B or any other moveable drive module except that the moveable idler module does not utilize a drive motor, belt or pulley to drive the idler roll 510. Rather, the idler roll 510 may be caused to rotate by the rotation of the associated drive roll 505 when the nip is engaged.

In an alternate embodiment, the moveable drive module may further include the idler roll. In such an embodiment, the drive roll and the idler roll may be positioned to form a nip and may move in concert as the moveable drive module moves in an inboard and/or outboard direction. For example, in the embodiment discussed in reference to FIGS. 3A and 3B, a second belt and pulley may be used to operably connect the translation drive motor 350 to a positioning shaft operably connected to the idler roll. In such an embodiment, the positioning shaft may operate in substantially the same manner as positioning shaft 340. Alternate methods of moving the idler roll in concert with the drive roll may also be used within the scope of this disclosure.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in die art which are also intended to be encompassed by the disclosed embodiments.

What is claimed is:

1. A system comprising:

a movable idler module comprising an idler roller; and a moveable drive module comprising:

a drive roll, and a first translation drive motor capable of moving the moveable drive module in a cross-process direction and capable of moving the movable idler module in a cross-process direction, wherein the moveable drive module and the moveable idler module are located in the same position in a process direction, wherein the process direction is a direction in which the moveable drive module and the moveable idler module are configured to move an object, and wherein the first translation drive motor is configured to move the moveable drive module and the movable idler module in concert.

2. The system of claim 1 wherein:

the moveable drive module is operably connected to a positioning shaft, and the first translation drive motor is configured to move the moveable drive module in an inbound direction by rotating the positioning shaft in a first direction and is configured to move the moveable drive module in an outbound direction by rotating the positioning shaft in a second direction opposite to the first direction.

3. The system of claim 2, further comprising:

a pulley attached to the positioning shaft, wherein the pulley and the positioning shaft have a common axis of rotation; and a belt operably connecting a drive shaft of the first translation drive motor and the pulley.

4. The system of claim 2 wherein:

the positioning shaft comprises a threaded shaft; and the moveable drive module is operably connected to the threaded shaft by a hub containing internal threads.

5. The system of claim 1 wherein the moveable drive module and the moveable idler module are configured to be located on opposite sides of a sheet in process.

6. A system comprising:

a movable idler module comprising an idler roller; and a moveable drive module comprising:

a drive roll, and a first translation drive motor capable of moving the moveable drive module in a cross-process direction and capable of moving the movable idler module in a cross-process direction, wherein the moveable drive module is configured to contact a top face of a sheet in process and the moveable idler module is configured to contact a bottom face of a sheet in process at the same position in a process direction, wherein the process direction is a direction in which the moveable drive module and the moveable idler module are configured to move an object, and wherein the first translation drive motor is configured to move the moveable drive module and the movable idler module in concert.

7. The system of claim 6 wherein:

the moveable drive module is operably connected to a positioning shaft, and the first translation drive motor is configured to move the moveable drive module in an inbound direction by rotating the positioning shaft in a first direction and is configured to move the moveable drive module in an outbound direction by rotating the positioning shaft in a second direction opposite to the first direction.

8. The system of claim 7, further comprising:

a pulley attached to the positioning shaft, wherein the pulley and the positioning shaft have a common axis of rotation; and a belt operably connecting a drive shaft of the first translation drive motor and the pulley.

9. The system of claim 7 wherein:

the positioning shaft comprises a threaded shaft; and the moveable drive module is operably connected to the threaded shaft by a hub containing internal threads.

* * * * *